US007309276B2

(12) United States Patent
Legaspi et al.

(10) Patent No.: US 7,309,276 B2
(45) Date of Patent: Dec. 18, 2007

(54) WIRELESS SUPPORT FOR BRASSIERE

(75) Inventors: Irene Dalindin Legaspi, Alpharetta, GA (US); Justina Mazza Lyons, Alpharetta, GA (US)

(73) Assignee: Vanity Fair, Inc., Wilmington, DE (US)

( * ) Notice: Subject to any disclaimer, the term of this patent is extended or adjusted under 35 U.S.C. 154(b) by 478 days.

(21) Appl. No.: 10/955,001

(22) Filed: Sep. 30, 2004

(65) Prior Publication Data

US 2005/0075048 A1 Apr. 7, 2005

Related U.S. Application Data

(60) Provisional application No. 60/507,126, filed on Oct. 1, 2003.

(51) Int. Cl.
*A41C 3/10* (2006.01)
*A41C 3/12* (2006.01)

(52) U.S. Cl. ..... 450/41; 450/92

(58) Field of Classification Search ..... 450/39–41, 450/43–48, 51–59, 60, 62, 92
See application file for complete search history.

(56) References Cited

U.S. PATENT DOCUMENTS 3,021,844 A * 2/1962 Flagg et al. ..... 450/39
3,146,779 A * 9/1964 Flagg ..... 450/39
4,816,004 A 3/1989 Emanuel
4,992,074 A 2/1991 Diaz
5,154,659 A 10/1992 Gluckin
5,755,611 A 5/1998 Noble et al.
5,946,726 A 9/1999 Green
5,957,748 A * 9/1999 Ichiha ..... 450/58
5,967,877 A 10/1999 Howard
6,116,985 A 9/2000 Lambert
6,165,045 A 12/2000 Miller et al.
6,238,266 B1 * 5/2001 Vogt ..... 450/19
6,299,504 B1 10/2001 Gluckin
6,306,005 B1 10/2001 Archer
6,402,585 B1 6/2002 Gatto et al.
6,425,800 B1 * 7/2002 Huang ..... 450/41
6,439,959 B1 8/2002 Magrone et al.
6,447,365 B1 9/2002 Powell et al.
6,544,101 B1 4/2003 von Sydow et al.
6,645,040 B2 * 11/2003 Rabinowicz et al. ..... 450/1
6,966,815 B2 * 11/2005 Weinerth ..... 450/41

* cited by examiner

*Primary Examiner*—Gloria M. Hale
(74) *Attorney, Agent, or Firm*—Kenyon & Kenyon LLP

(57) ABSTRACT

The invention is directed to a wireless support system for a brassiere. The wireless support system comprises at least one centerfront support and two sideback supports which are composed of a material such as a polyester film. The two sideback supports may be attached to the centerfront support via a stabilizing ribbon or stitches. The brassiere of the present invention has the advantage of providing comfortable support that is form fitting.

54 Claims, 6 Drawing Sheets

WIRELESS SUPPORT FOR BRASSIERE

CROSS-REFERENCE TO RELATED APPLICATIONS

This invention claims the benefit under 35 U.S.C. § 119(e) of U.S. Provisional Application No. 60/507,126 filed Oct. 1, 2003, which is herein incorporated by reference in its entirety.

FIELD OF THE INVENTION

This invention is directed to brassieres. More particularly, this invention is directed to a wireless support system for a brassiere or other breast supporting garments.

BACKGROUND OF THE INVENTION

Brassieres provide support and enhance the shape of breasts. Brassieres often have a device in the cups of the brassiere to provide support. Devices intended to provide support and shaping for the cups of a bra and similar articles have long been known. These devices are commonly known as underwires and are inserted into and held within a fabric sleeve disposed about the periphery of the lower section of the bra cup. They are made from materials, such as bone, metal or plastic, and are provided in various forms, shapes and cross-sections. Most commonly, the underwire is formed of relatively thin metallic pieces of rectangular cross-section, shaped into an essentially semi-circular or U-shaped form that allows the underwire to be fitted within a sleeve disposed about the periphery of the lower half of the bra cup.

While such underwire structures have achieved widespread usage, a number of significant disadvantages result from their use. In particular, the underwires can damage the fabric sleeve into which the underwire is inserted or irritate the skin of a user leading to discomfort and sometimes bruising. Deformation or distortion of the underwires arises from washing and drying of bras containing underwires. Multiple washings lead to degradation of the fabric of the garment due to shrinkage of the fabric and/or the relative movement occurring between the stiff, rigid metal underwire and the fabric of the bra brought about in machine washing and drying. Using underwires coated with a polymeric material or metal underwires that have plastic tips at their ends does not alleviate these problems completely.

SUMMARY OF THE INVENTION

It is a primary object of the present invention to provide a wireless support structure for breast-supporting articles, such as bras (with or without straps), swimwear, sportswear, contour or bra pads, daywear, camisoles and the like, that provides the necessary rigidity to accomplish its supporting function.

It is another object of the present invention to provide a wireless support structure for breast supporting articles that is form fitting, to avoid unsightly gaps in the supporting articles underneath the breast.

It is a preferred object of the present invention to provide a brassiere comprising (i) an outer layer having two front bra cups and two back bands extending from the lateral sides of the two front bra cups; (ii) two sideback supports adhered to the outer sides of the front bra cups and inside the outer layer; (iii) at least one centerfront support adhered to the inner sides of the front bra cups and inside the outer layer, as shown in the drawings; and (iv) an inner layer having two front bra cups with side backs extending from the lateral sides of the two front bra cups, wherein the two side backs end approximately at the outermost edge of the two sideback supports, and further wherein the inner layer is adhered to the two sideback supports and at least one centerfront support. The sideback supports and the centerfront support(s) are preferably made of Mylar®.

It is a second preferred object of the present invention to provide a brassiere comprising (i) an outer layer having two front bra cups and a single back band extending from the lateral side of the first bra cup to the lateral side of the second bra cup; (ii) two sideback supports adhered to the outer sides of the front bra cups and inside the outer layer; (iii) two centerfront supports adhered to the inner sides of the front bra cups and inside the outer layer, as shown in the drawings; and (iv) two inner layers each having one front bra cup with a side back extending from the lateral sides of each of the two front bra cups, wherein the two side backs end approximately at the outermost edge of the two sideback supports, and further wherein the inner layer is adhered to the two sideback supports and two centerfront supports. The sideback supports and the centerfront support(s) are preferably made of Mylar®.

DETAILED DESCRIPTION OF THE PREFERRED EMBODIMENTS

Figure 1A:
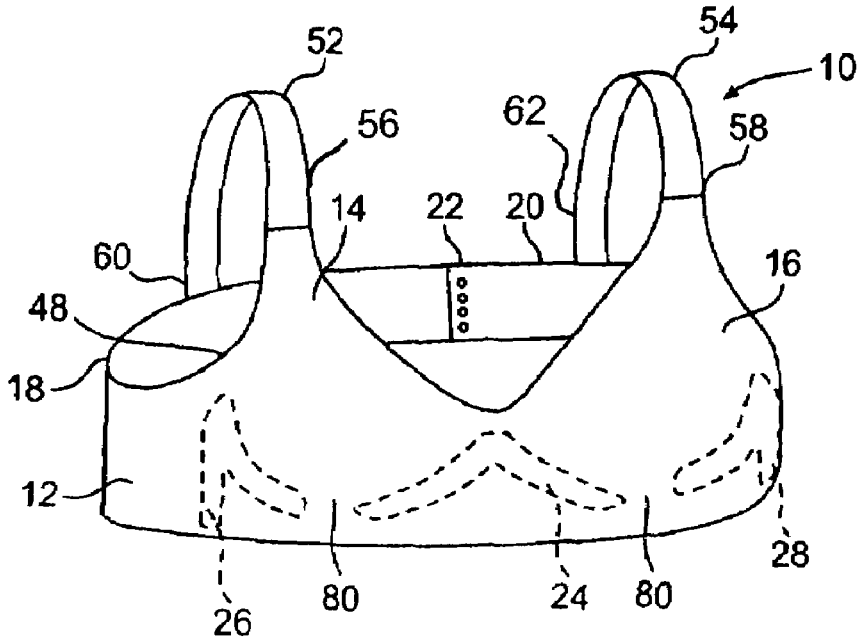
FIG. 1*a* is a perspective view of a brassiere showing the front of a frame of a wireless support system according to one embodiment of the present invention.

Referring to FIG. 1*a*, a perspective view of a bra 10 made according to the present invention is shown. It will be understood that the present invention can be incorporated into any style bra, swimsuit or other undergarment known to those of ordinary skill in the art. The bra 10 features an outer layer, 12, having two front bra cups, 14 and 16, and two back bands, 18 and 20, extending from the lateral sides of the two outer layer front bra cups, 14 and 16, and preferably having a back retaining device, 22, attached to the ends of the back bands and including a set of locking pieces engageable with each other. Preferably, the outer layer is made of two or more pieces of material, but in an alternative embodiment the outer layer may be made of one piece of material.

Figure 3A:
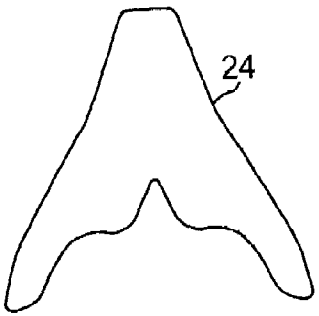
FIGS. 3*a*-3*e* are perspective views of embodiments of centerfront supports for the wireless support system of the present invention.
Figure 3B:
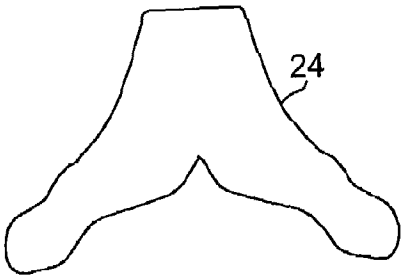
Figure 3C:
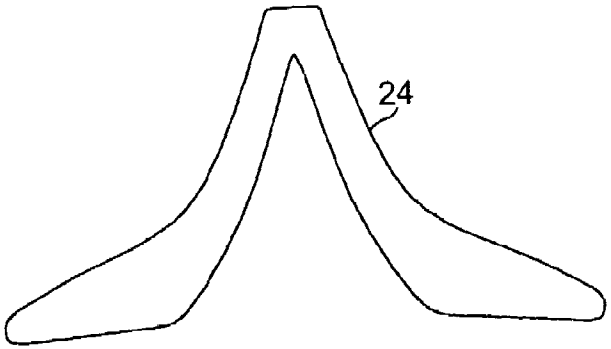
Figure 3D:
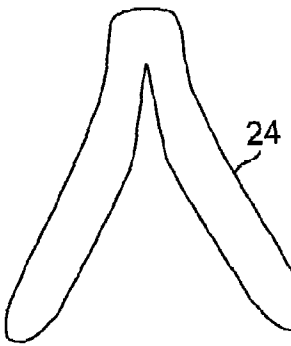
Figure 3E:
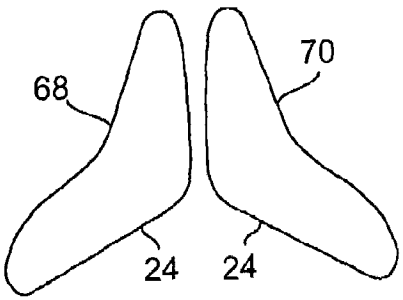

The bra 10 also features at least one centerfront support 24 and two sideback supports 26 and 28. The centerfront support 24 is located between the two outer layer front bra cups, 14 and 16. The centerfront support 24 may be in the shape of an inverted V, as shown in FIGS. 3*a*-3*d*, the sides of the V following the shape of the two outer layer front bra cups, 14 and 16. The opening between the two bottom ends of the inverted V may be of varying shapes and sizes. Alternatively, the centerfront support 24 may be comprised of two separate support pieces, 68 and 70, as shown in FIG. 3*e*, that follow the shape of the outer layer front bra cups. The sides of the centerfront support 24, as shown in FIGS. 3*a*-3*d*, or the two separate centerfront supports, 24, as shown in FIG. 3*e*, may be joined together by a stabilizing ribbon.

The bra 10 also features two sideback supports, 26 and 28. The sideback supports 26 and 28 follow the shapes of the outer layer front bra cups, 14 and 16, from the bottom of the outer layer front bra cups to the outer sides. The sideback supports, 26 and 28, may have one or multiple slits, 32, and/or legs, 34, on the side (see FIGS. 2*a*-2*f*) that allow for proper fitting of the bra 10 to the body. The legs, 34, may be joined together by stabilizing ribbons or alternatively by various stitch-type configurations known in this art (such as single needle, double needle, three step zig zag, two step zig zag, etc.). A flexibility gap 80 exists between the sideback supports, 26 and 28, and the centerfront support(s), 24. This flexibility gap allows for proper fitting, without bulges, to the body. The sideback supports 26 and 28 may be held to the centerfront support(s) 24 by stabilizing ribbons which span the flexibility gaps, 80 or alternatively by various stitch-type configurations known in this art (such as single needle, double needle, three step zig zag, two step zig zag, basting, etc.).

The centerfront supports, 24, and the sideback supports, 26 and 28, are preferably made of a flexible, stable, and rigid plastic or polyester material. More preferably, the centerfront support(s), 24, and sideback supports, 26 and 28, are made of a polyester film that is flexible, stable and rigid. The polyester film is preferably Mylar®, and is preferably pre-bonded with an adhesive, such as an adhesive film. For example, the Mylar® used in the present invention may be Mylinex® #561 (obtained from Tecra®) which is a Mylar® film pre-bonded with Bemis #3402, an adhesive film, and pretreated on both sides for improved adhesion of inks and coatings, and specially formulated for improved die cutting. Bemis #3402 is a soft, highly elastic, polyurethane adhesive film designed for intimate apparel applications, to provide excellent bond strength while maintaining the softness, stretch, recovery, and molding properties that are critical in intimate apparel.

Mylinex® #561 is a tough, general purpose film that is transparent and pretreated to have a textured surface to provide ease of handling, good adhesion, and processability. Mylinex® #561 is translucent in heavier gauges and has balanced tensile properties and excellent resistance to moisture and most chemicals. Mylinex® #561 can withstand temperature extremes from −100° F. to 300° F., and does not become brittle with age under normal conditions. Of course, other polyester films with properties similar to Mylar® or Mylinex® #561, and other adhesives or adhesive films to be applied to Mylar®, may be used in the present invention. For example, adhesive webs, powders, or dots may be applied to the polyester film.

Figure 1B:
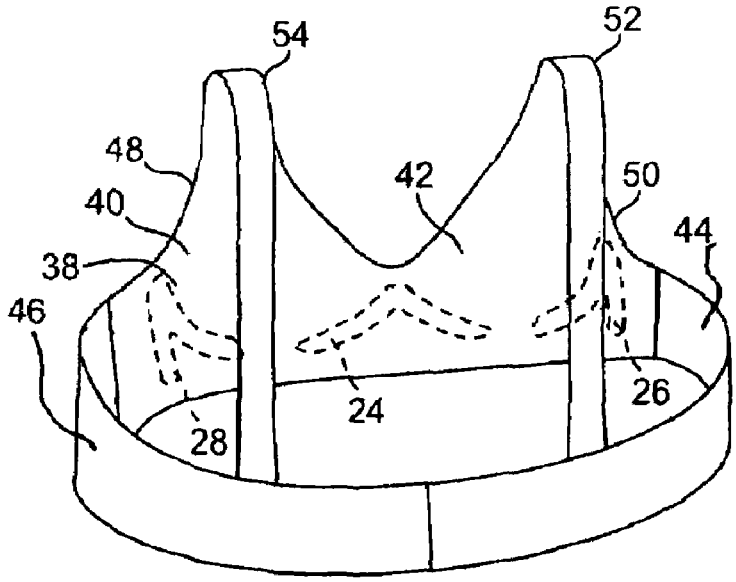
FIG. 1*b* is a perspective view of a brassiere showing the back of a frame of a wireless support system according to one embodiment of the present invention.
Figure 2A:
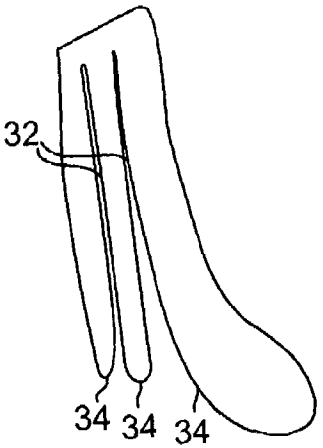
FIGS. 2*a*-2*f* are perspective views of embodiments of sideback supports for the wireless support system of the present invention.
Figure 2B:
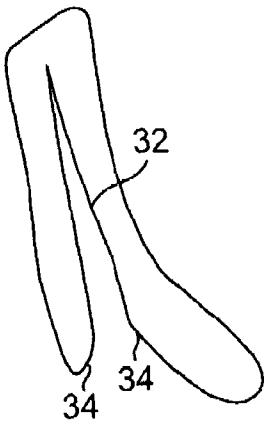
Figure 2C:
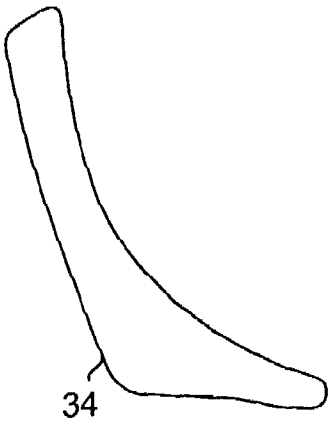
Figure 2D:
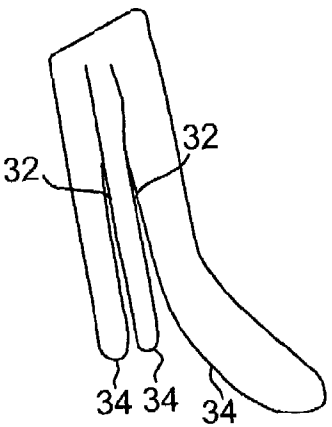
Figure 2E:
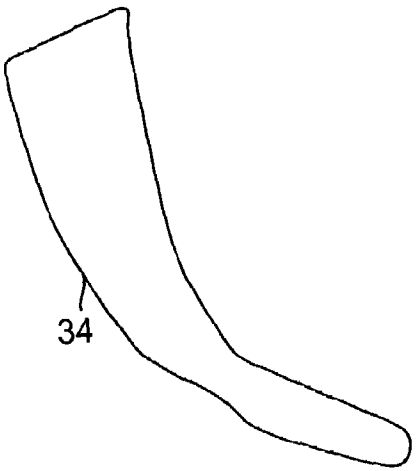
Figure 2F:
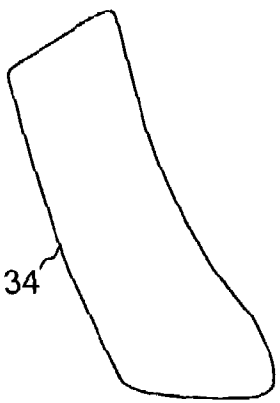

The bra 10 also features an inner layer, 38, having two front bra cups, 40 and 42, and two back bands, 44 and 46, extending from two lateral sides thereof, respectively, wherein the two back bands, 44 and 46, end approximately at the outermost edge of the two sideback supports, 26 and 28 (see FIG. 1*b*). In an alternative embodiment, the inner layer, 38, extends beyond the two sideback supports, 26 and 28, to the end of the back bands, 18 and 20 of the outer layer. The inner layer may be composed of one or more pieces of material. The front bra cups of the inner layer, 40 and 42, are formed such that they fit together with the front bra cups of the outer layer, 14 and 16, and together they form the front bra cups of the bra, 48 and 50.

The outer layer is typically made of a decorative/non-decorative material such as lace, jacquard or satin. The inner layer is preferably made of a soft material that absorbs and wicks moisture away, such as cotton or polypropylene cloth. The stabilizing ribbons are preferably made of a cotton or polypropylene cloth. The type of fabric used for the bra of the present invention will of course depend on the proposed use of the bra (everyday use, sports bra, swimsuit, etc.).

Figure 4:
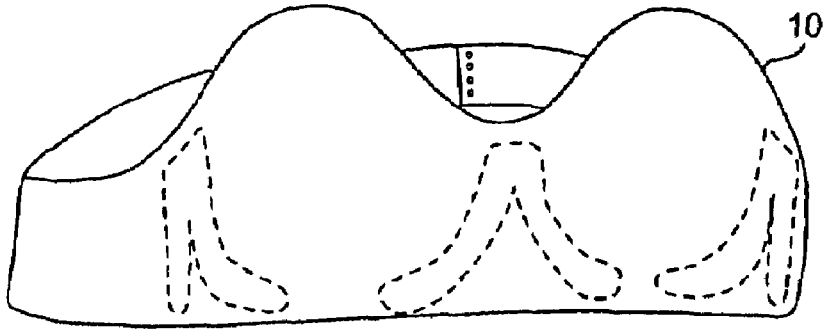
FIG. 4 is a perspective view of a brassiere showing a frame of a wireless support system according to a second embodiment of the present invention, in which the brassiere is strapless.

The optional shoulder straps, 52 and 54, are each located with a first end, 56 and 58, attached to the top edge of the bra cups, 48 and 50, and a second end, 60 and 62, attached to the back bands, 18 and 20, and have a conventional plastic buckle attached thereto that allows for the straps to be adjusted for length. Alternative embodiments of the shoulder straps include a "racerback" design, in with the shoulder straps join together in the back of the bra and connect as one to the back bands (in the case of a bra without locking pieces) or divide again into two, each connecting to either side of the back retaining device, 22. FIG. 4 depicts an embodiment of the present invention that does not have the optional shoulder straps.

Figure 5A:
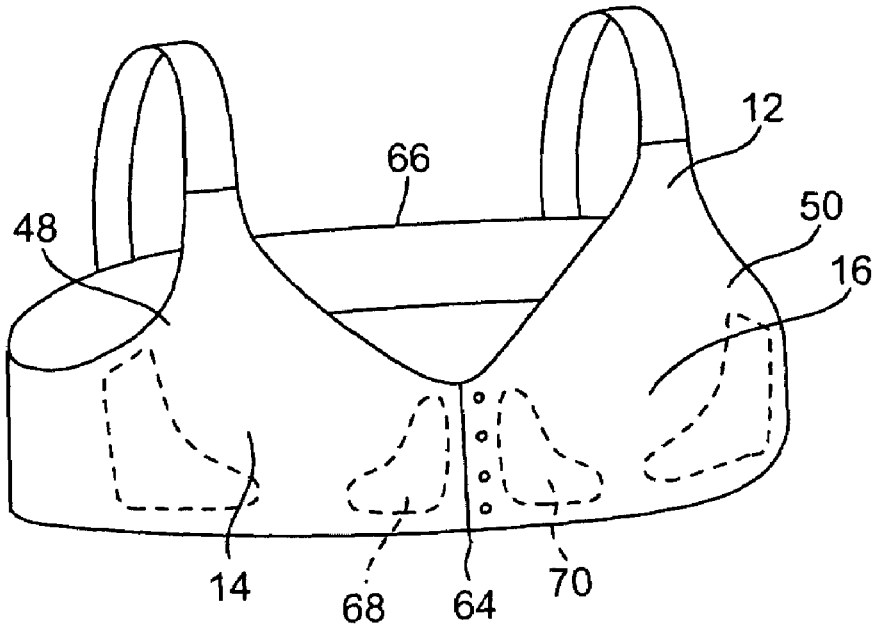
FIG. 5*a* is a perspective view of a brassiere showing a frame of a wireless support system according to a third embodiment of the present invention, in which the brassiere connects at the front of the body.

In an alternative embodiment of the present invention, the bra has a front retaining device, 64 including a set of locking pieces engageable with each other (see FIG. 5*a*) instead of a back retaining device. In this embodiment, the outer layer, 12, has two separated front bra cups, 14 and 16, and a single back band, 66, connecting said two separated front bra cups, 14 and 16. Similar to the previous embodiment, this embodiment of the present invention includes two sideback supports, 26 and 28. The bra of this embodiment has two centerfront supports, 68 and 70, one each located between the front bra cups, 14 and 16, and the front retaining device.

Figure 5B:
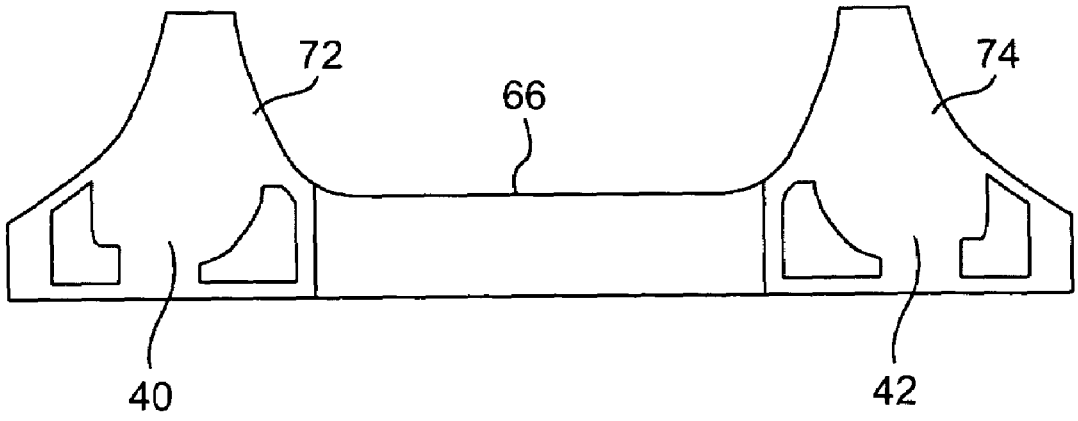
FIG. 5*b* is a perspective view of a brassiere showing the back of a frame of a wireless support system according to a third embodiment of the present invention, in which the brassiere connects at the front of the body.

In this alternative embodiment, the inner layer may be comprised of two separate pieces of material, 72 and 74 (see FIG. 5*b*). Alternatively, the inner layer may be comprised of a single piece of material that follows the same pattern as the outer layer, 12 (embodiment not depicted).

In any of the embodiments of the present invention, the bra cups, 48 and 50, may further comprise bra pads, which will enhance the shape of the bust. These bra pads may be made of material known to one of skill in the art, including commonly known foam (polyester or polyether), spacer, fiberfill or gel, and may or may not be removable from the bra.

Figure 6:
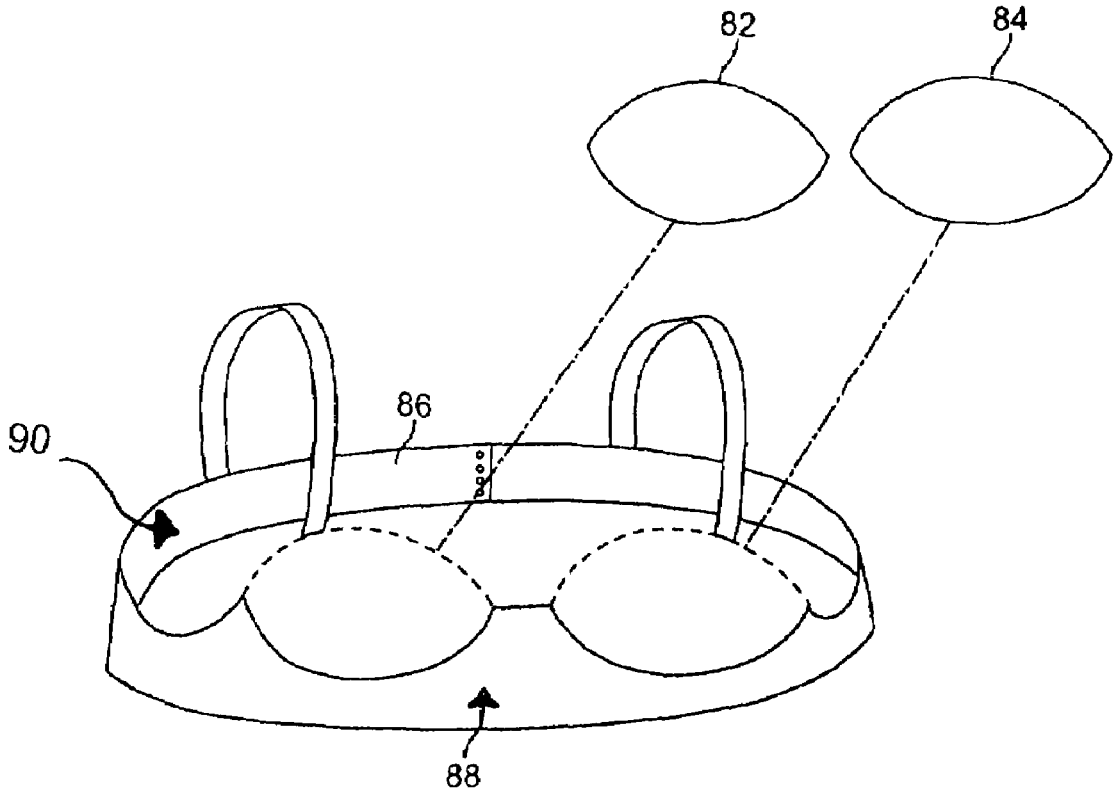
FIG. 6 is a perspective view of a brassiere showing a frame of a wireless support system according to a fourth embodiment of the present invention, a banded set in bra cup brassiere, in which the bra cups are produced separately from the rest of the brassiere frame, and subsequently attached to the appropriate place on the frame.

Furthermore, as depicted in FIG. 6, in any of the embodiments of the present invention (i.e., whether strapless, front clasp, or rear clasp), the bra cups may be set in bra cups, 82 and 84, set within a frame, 86. In the art, such a brassiere is referred to as a banded set in bra cup brassiere. The set in bra cups, 82 and 84, are made separately from the frame, 86, of the brassiere, and then attached to the frame, 86, prior to completion. In such an embodiment, the outer and inner layers, 88 and 90, of the frame of the brassiere have two U-shaped cut-outs in the front of the frame, into which the completed set in bra cups, 82 and 84, are set and attached. Prior to or after attaching the set in bra cups, 82 and 84, to the front of the frame, 86, the shoulder straps (if present) are attached to the set in bra cups, 82 and 84. The set in bra cups, 82 and 84, may have a bra pad, as disclosed above, and may further be comprised of an outer and/or inner layer of material.

Figure 7A:
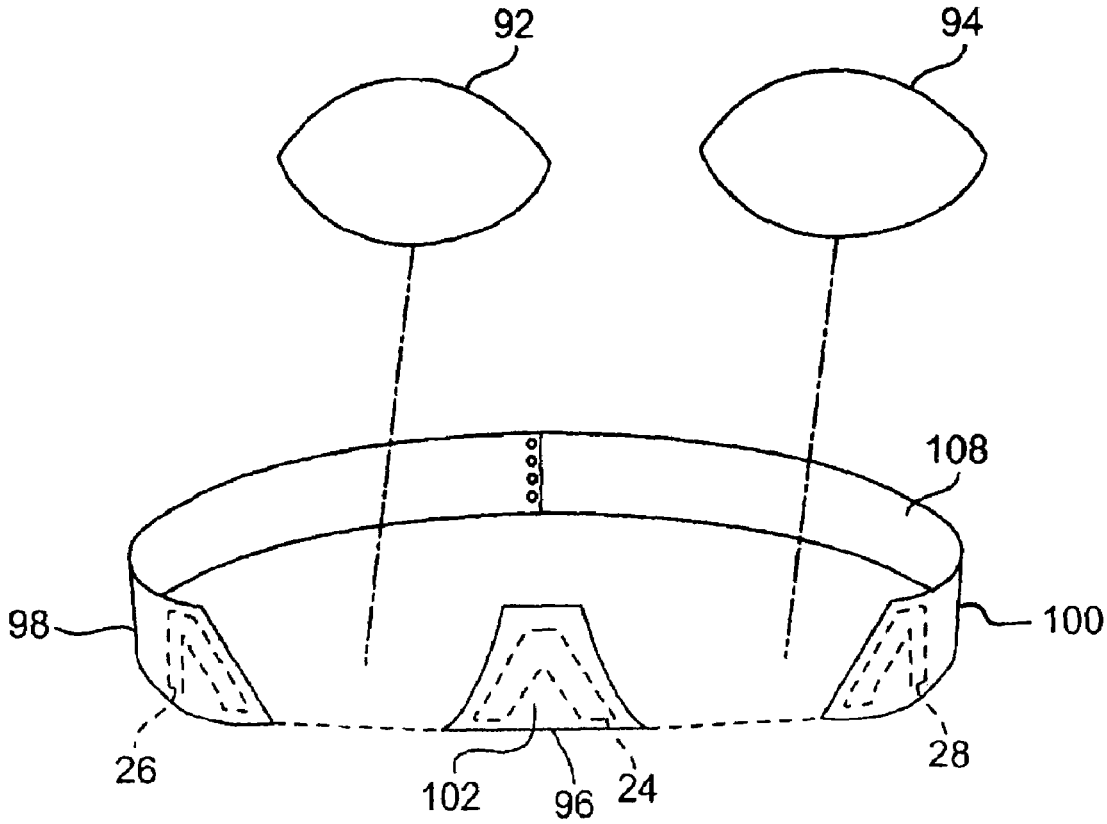
FIG. 7*a* is a perspective view of a brassiere showing a wireless support system according to a fifth embodiment of the present invention, a bandless, or un-banded, set in bra cup brassiere, in which the bra cups, front band and back bands are each produced separately and subsequently attached to one another, with the front band located between the two bra cups and the back bands attached to the lateral sides of said bra cups.
Figure 7B:
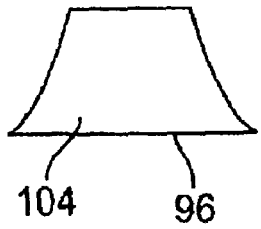
FIG. 7*b* is a perspective view of the back of the front band of the brassiere according to the fifth embodiment of the present invention.

In addition, as depicted in FIG. 7*a*, in any of the embodiments of the present invention (i.e., whether strapless, front clasp, or rear clasp), the bra cups may be set in bra cups, 92 and 94, and the brassiere frame may be composed of a center band, 96, which is affixed between the bra cups, 92 and 94, and two back bands, 98 and 100, may be affixed to the lateral sides of the set in bra cups, 92 and 94. In the art, such a brassiere is referred to as a bandless set in bra cup brassiere. In this embodiment, the center band, 96, has an outer and an inner layer, 102 and 104, and the centerfront support, 24, is placed between the outer and inner layers, 102 and 104, of the center band, 96, prior to attaching the center band, 96, to the set in bra cups, 92 and 94. Similarly, the back bands, 98 and 100, have outer and inner layers, 106 and 108, and the sideback supports, 26 and 28, are placed between the outer and inner layers, 106 and 108, of the back bands, 98 and 100, prior to attaching the back bands, 98 and 100, to the set in bra cups, 92 and 94. The set in bra cups, 92 and 94, may have a bra pad, as disclosed above, and may further be comprised of an outer and/or inner layer of material.

Moreover, in any of the embodiments of the present invention, the bra may be a maternity and/or nursing bra, in which front bra cups, 14 and 15, can be partially detached by the wearer to expose the breast for breastfeeding.

The bra, 10, of the present invention is made generally by cutting the inner layer, 38 (using a GERBERCUTTER® or die cutter), to the appropriate size, removing release paper (not shown) and placing the sideback supports, 26 and 28, and the centerfront support(s), 24 or 72 and 74, on the appropriate location on the inside part of the outer layer (also cut using a GERBERCUTTER® or die cutter), with the film (texturized) side up. The sideback supports, 26 and 28, the centerfront support(s), 24 or 72 and 74, and the inner layer, 38, are preferably pre-bonded with an adhesive. The sideback supports and the centerfront support(s) may be adhered to the inner layer with a glue stick and/or a heat regulated tool type-gun so as to spot seal them, reinforcing the proper placement prior to the final press bond sealing. The outer layer, 12, cut to the appropriate size, is then placed on top of the inner layer/centerfront support/sideback support assembly, and aligned properly. This assembly is then heat pressed, permanently bonding all layers. As an exemplary embodiment, the heat press has a temperature of about 350-400.degree. F., and is left on the assembly for approximately 25-45 seconds (dwell time). One of skill in the art could easily adjust the temperature of the press and the dwell time in accordance with the types of fabric, adhesive, and polyester film used to make the bra of the present invention. After the bra assembly is cooled, it is cut into the desired shape using an automated cutter. As an alternative, the bra assembly may be die cut into the desired shape. In the embodiment in which set in bra cups 82 and 84, or 92 and 94, are used (whether in a banded or bandless set in bra cup brassiere), the brassiere frame or the center band and back bands (including the inner and outer layer, sideback supports, and centerfront supports) is/are constructed, similar to as described above, and the set in bra cups 82 and 84, or 92 and 94, are made separately and then attached to the brassiere frame (as described above) or to the center band and back bands (as described above).

While it is apparent that the illustrative embodiments of the invention herein disclosed fulfill the objectives stated above, it will be appreciated that numerous modifications and other embodiments may be devised by those skilled in the art. For example, the present invention could be made of a variety of materials. Furthermore, the centerfront and sideback supports could be shaped differently to provide different support for different bust sizes. Therefore, it will be understood that the appended claims are intended to cover all such modifications and embodiments which come within the spirit and scope of the present invention.

We claim:

1. A brassiere comprising:

(i) an outer layer, wherein said outer layer has two front bra cups and two back bands extending from two lateral sides of the outer layer, respectively;

(ii) two sideback supports adhered to outer sides of said front bra cups;

(iii) at least one centerfront support adhered between the two front bra cups and a flexibility gap is located between each sideback support and the at least one centerfront support; and (iv) an inner layer, wherein said inner layer has two front bra cups and two back bands extending from two lateral sides of the inner layer, respectively, wherein said two back bands end approximately at the outermost edge of said two sideback supports, and wherein said inner layer is adhered to said two sideback supports and said at least one centerfront support.

2. The brassiere of claim 1, wherein said two back bands connect to each other.

3. The brassiere of claim 1, further comprising a back retaining device attached to ends of the back bands and including a set of locking pieces engageable with each other.

4. The brassiere of claim 1, wherein said two sideback supports are connected to said centerfront support allowing for flexibility.

5. The brassiere of claim 4, wherein said two sideback supports are connected to said centerfront support by stitches.

6. The brassiere of claim 1, further comprising two shoulder straps, each connected to the back bands and the front bra cups.

7. The brassiere of claim 1, further comprising a bra pad located in each of said bra cups between the outer layer and the inner layer.

8. The brassiere of claim 7, wherein said bra pad is made from a material selected from the group consisting of polyester foam, polyether foam, spacer, fiberfill and gel.

9. The brassiere of claim 1, wherein said sideback supports are each comprised of a polyester film.

10. The brassiere of claim 9, wherein said polyester film has an adhesive applied thereto.

11. The brassiere of claim 1, wherein said at least one centerfront support is comprised of a polyester film.

12. The brassiere of claim 11, wherein said polyester film has an adhesive applied thereto.

13. The brassiere of claim 1, wherein said at least one centerfront support is shaped like an inverted V, with a single top and two bottoms.

14. A brassiere comprising:

(i) an outer layer, wherein said outer layer has two bra cups and a single back band connecting said two bra cups;

(ii) two sideback supports adhered to outer sides of said front bra cups;

(iii) a centerfront support adhered to the inner sides of said two front bra cups and inside the outer layer, and a flexibility gap is located between each sideback support and the at least one centerfront support; and (iv) an inner layer, wherein said inner layer each has a front bra cup and a back band extending from the lateral side thereof, wherein said back band ends approximately at an outermost edge of said sideback supports, and wherein said inner layer is adhered to said two sideback supports and said centerfront support.

15. The brassiere of claim 14, further comprising a front retaining device attached to ends of the front bra cups and including a set of locking pieces engageable with each other.

16. The brassiere of claim 14, wherein said two sideback supports are connected to said centerfront support allowing for flexibility.

17. The brassiere of claim 16, wherein said two sideback supports are connected to said centerfront support by stitches.

18. The brassiere of claim 14, further comprising two shoulder straps, each connected to the back bands and the front bra cups.

19. The brassiere of claim 14, further comprising a bra pad located in each of said bra cups between the outer layer and the inner layer.

20. The brassiere of claim 14, wherein said sideback supports are each comprised of a polyester film.

21. The brassiere of claim 20, wherein said polyester film has an adhesive applied thereto.

22. The brassiere of claim 14, wherein said centerfront support is comprised of a polyester film.

23. The brassiere of claim 22, wherein said polyester film has an adhesive applied thereto.

24. The brassiere of claim 14, wherein said centerfront support is shaped like an inverted V, with a single top and two bottoms.

25. A brassiere comprising:

(i) two bra cups;

(ii) a frame comprising a front band with two U-shaped cutouts where said two bra cups are attached, and two back bands extending from lateral sides of said front band, wherein said front band comprises an outer and inner layer;

(iii) two sideback supports adhered to the outer layer of said front band, between the inner and outer layers of said front band, on outer sides of said bra cups; and (iv) at least one centerfront support adhered to the inside of the outer layer of said front band, between the inner and outer layers of said front band, between the two bra cups, and a flexibility gap is located between each sideback support and the at least one centerfront support.

26. The brassiere of claim 25, wherein said two back bands connect to each other.

27. The brassiere of claim 25, further comprising a back retaining device attached to ends of the back bands and including a set of locking pieces engageable with each other.

28. The brassiere of claim 25, wherein said two sideback supports are connected to said at least one centerfront support allowing for flexibility.

29. The brassiere of claim 28, wherein said two sideback supports are connected to said at least one centerfront support by stitches.

30. The brassiere of claim 25, wherein said sideback supports are each comprised of a polyester film.

31. The brassiere of claim 30, wherein said polyester film has an adhesive applied thereto.

32. The brassiere of claim 25, wherein said at least one centerfront support is comprised of a polyester film.

33. The brassiere of claim 32, wherein said polyester film has an adhesive applied thereto.

34. The brassiere of claim 25, wherein said at least one centerfront support is shaped like an inverted V, with a single top and two bottoms.

35. The brassiere of claim 25, wherein said set in bra cups comprise at least an inner layer.

36. The brassiere of claim 25, wherein said set in bra cups comprise at least an outer layer.

37. The brassiere of claim 25, wherein said set in bra cups comprise at least an outer layer and an inner layer.

38. The brassiere of claim 25, wherein said back bands comprise an outer and inner layer.

39. A brassiere comprising:

(i) two bra cups;

(ii) a front band connecting said two set in bra cups, and comprising an outer and an inner layer;

(iii) two back bands extending from lateral sides of said two bra cups, wherein said back bands comprise an outer layer and at least a partial inner layer;

(iv) two sideback supports, one each adhered to the outer layer of said two back bands, between said outer layer and said at least a partial inner layer of said back bands, on outer sides of said bra cups; and (v) at least one centerfront support adhered to the outer layer of said front band, between the inner and outer layers of said front band, between the two bra cups, and a flexibility gap is located between each sideback support and the at least one centerfront support.

40. The brassiere of claim 39, wherein said two back bands connect to each other.

41. The brassiere of claim 39, wherein said sideback supports are each comprised of a polyester film.

42. The brassiere of claim 41, wherein said polyester film has an adhesive applied thereto.

43. The brassiere of claim 39, wherein said at least one centerfront support is comprised of a polyester film.

44. The brassiere of claim 43, wherein said polyester film has an adhesive applied thereto.

45. The brassiere of claim 39, wherein said at least one centerfront support is shaped like an inverted V, with a single top and two bottoms.

46. The brassiere of claim 39, wherein said set in bra cups comprise at least an inner layer.

47. The brassiere of claim 39, wherein said set in bra cups comprise at least an outer layer.

48. The brassiere of claim 39, wherein said set in bra cups comprise at least an outer layer and an inner layer.

49. The brassiere of claim 39, wherein said back bands comprise an outer and an inner layer.

50. The brassiere of claim 39, wherein said at least a partial inner layer of said two back bands extends to the later almost edge of the said side back supports.

51. The brassiere of claim 39, wherein said at least a partial inner layer of said two back bands extends to where the outer layer of said two back bands ends.

52. A brassiere comprising:

(i) an outer layer, wherein said outer layer has two front bra cups and two back bands extending from two lateral sides of the outer layer, respectively;

(ii) two sideback supports adhered to outer sides of said front bra cups and inside the outer layer;

(iii) at least one centerfront support adhered between the two front bra cups and inside the outer layer, and a flexibility gap is located between each sideback support and the at least one centerfront support; and (iv) an inner layer, wherein said inner layer has two front bra cups and two back bands extending from two lateral sides of the inner layer, respectively, wherein said two back bands end approximately at the outermost edge of said two back bands of the outer layer, and wherein said inner layer is adhered to said two sideback supports and said at least one centerfront support.

53. A brassiere comprising:

(i) an outer layer, wherein said outer layer has two front bra cups and a single back band connecting said two bra cups;

(ii) two sideback supports adhered to outer sides of said front bra cups (iii) a centerfront support adhered to each of inner sides of said two front bra cups and inside the outer layer, and a flexibility gap is located between each sideback support and the at least one centerfront support; and (iv) an inner layer, wherein said inner layer has two separate front bra cups and a single back band extending from lateral sides of the inner layer, connecting said two bra cups.

54. A brassiere comprising:

(i) an outer layer, wherein said outer layer has two front bra cups and two back bands extending from two lateral sides of the outer layer, respectively, and wherein said two back bands include a set of locking pieces engageable with each other;

(ii) two sideback supports made of a polyester film adhered to outer sides of said front bra cups;

(iii) at least one centerfront support made of a polyester film adhered between the two front bra cups and inside the outer layer, wherein said centerfront support is shaped like an inverted V, with a single top and two bottoms; and (iv) an inner layer, wherein said inner layer has two front bra cups and two back bands extending from two lateral sides of the inner layer, respectively, wherein said two back bands end approximately at an outermost edge of said two sideback supports, and wherein said inner layer is adhered to said two sideback supports and said at least one centerfront support.

* * * * *

UNITED STATES PATENT AND TRADEMARK OFFICE

CERTIFICATE OF CORRECTION

PATENT NO. : 7,309,276 B2
APPLICATION NO. : 10/955001
DATED : December 18, 2007
INVENTOR(S) : Irene Dalindin Legaspi et al.

It is certified that error appears in the above-identified patent and that said Letters Patent is hereby corrected as shown below:

| Column | Line | |
|---|---|---|
| 7 | 13, | Change "has two bra" to --has two front bra-- |
| 8 | 26, | Change "said set in bra cups" to --said bra cups-- |
| 8 | 28, | Change "said set in bra cups" to --said bra cups-- |
| 8 | 30, | Change "said set in bra cups" to --said bra cups-- |
| 8 | 36, | Change "said two set in bra cups" to --said two bra cups-- |
| 8 | 64, | Change "said set in bra cups" to --said bra cups-- |
| 8 | 66, | Change "said set in bra cups" to --said bra cups-- |
| 9 | 1, | Change "said set in bra cups" to --said bra cups-- |
| 9 | 6, | Change "later" to --lateral-- |

Signed and Sealed this

Ninth Day of February, 2010

David J. Kappos

David J. Kappos
*Director of the United States Patent and Trademark Office*